US005118009A

United States Patent [19]

Novitsky

[11] Patent Number: 5,118,009

[45] Date of Patent: Jun. 2, 1992

[54] CARBONATED BEVERAGE DISPENSER, SYSTEM AND METHOD

[76] Inventor: Charles Novitsky, 7606 7th Ave., Brooklyn, N.Y. 11209

[21] Appl. No.: 622,611

[22] Filed: Dec. 5, 1990

Related U.S. Application Data

[63] Continuation-in-part of Ser. No. 412,089, Sep. 28, 1989, abandoned.

[51] Int. Cl.[5] ..... B67D 5/00

[52] U.S. Cl. ..... 222/1; 222/81; 222/88; 222/183; 222/325

[58] Field of Search ..... 222/81, 82, 835, 87-89, 222/131, 183, 185, 182, 278, 288, 394, 512, 514, 562, 146.6, 1, 325, 518; 220/DIG. 9, 903

[56] References Cited

U.S. PATENT DOCUMENTS

| | | | |
|---|---|---|---|
| 825,173 | 7/1906 | Ansley | 222/83.5 |
| 2,137,041 | 11/1938 | Barnes | 222/183 |
| 2,184,397 | 12/1939 | Nelson | 222/88 |
| 2,246,693 | 6/1941 | Ohme | 222/83.5 |
| 2,536,221 | 1/1951 | Bector et al. | 222/88 |
| 2,655,286 | 10/1953 | Barbaro | 222/185 |
| 2,685,978 | 8/1954 | Crackett | 222/518 |
| 2,722,210 | 11/1955 | Koonce | 222/83.5 |
| 2,726,789 | 12/1955 | Perry | 184/105.1 |
| 3,168,219 | 2/1965 | Kamp | 222/82 |
| 3,424,347 | 1/1969 | Trodglen, Jr. | 222/88 |
| 3,910,461 | 10/1975 | Eager | 222/131 |
| 4,491,244 | 1/1985 | Yanes | 222/88 |
| 4,778,081 | 10/1988 | Vaughan | 222/83.5 |
| 4,921,135 | 5/1990 | Pleet | 222/82 |

FOREIGN PATENT DOCUMENTS

| | | | |
|---|---|---|---|
| 616328 | 1/1927 | France | 222/88 |

*Primary Examiner*—Michael S. Huppert
*Assistant Examiner*—Philippe Derakshani
*Attorney, Agent, or Firm*—Roper & Quigg

[57] ABSTRACT

The invention is directed to a carbonated beverage dispenser and to a method of dispensing carbonated beverage. The dispenser comprises a canister having a side wall, a bottom wall and an open end with a removable lid for closing the open end during operation. A dispensing tube having a puncturing end is provided in the bottom of the canister for puncturing a beverage container loaded into the canister. The dispensing tube is connected to a flow control valve for controlling dispensing of beverage from the container. Low pressure beverage containers such as plastic or glass bottles and aluminum cans can be used in the dispenser by shaking the canister and container of beverage therein to agitate the carbonated beverage and release dissolved carbon dioxide gas prior to dispensing a serving in order to eventually dispense the entire contents of the beverage container. The dispenser effects a seal with the punctured opening to prevent the carbonated beverage from going flat in the time between the dispensing of different servings.

23 Claims, 4 Drawing Sheets

CARBONATED BEVERAGE DISPENSER, SYSTEM AND METHOD

This application is a continuation-in-part of copending application Ser. No. 07/412,089, now abandoned filed Sep. 28, 1989.

BACKGROUND OF THE INVENTION

1. Field of the Invention

This invention relates to a beverage dispenser, system and method for carbonated beverages. In particular, the invention is directed to a beverage dispenser and system for accommodating and dispensing the contents of low pressure carbonated beverage containers. Further, the beverage dispenser can be insulated and can accommodate different sized and shaped beverage containers. The invention includes a method of dispensing using a dispenser operated by agitating the carbonated beverage in a beverage container inserted in the dispenser to release dissolved carbon dioxide to provide gas for powering the dispensing operation.

2. Prior Art

There exist a number of devices such as coolers for transporting and storing beverage containing bottles and cans. Typically, the bottles and cans are placed in the cooler with ice for cooling and maintaining the beverage at a temperature desirable for consumption. These beverage containers contain carbonated beverages having a certain amount of dissolved carbon dioxide. When these bottles or cans are opened, and subjected to the lower pressure ambient atmosphere, carbon dioxide gas is released which causes fizzing when the beverage is agitated such as when pouring the beverage into a drinking receptacle. If the container is left open over a long period of time, the carbonation is lost and the beverage becomes flat.

There also exist a number of seltzer water dispensers that include a mixing chamber for water and carbon dioxide gas supplied from carbon dioxide cartridges. The carbon dioxide mixes with the water to become seltzer water, and the increased pressure in the mixing chamber powers the dispensing of the seltzer water.

A device related to the present invention for dispensing carbonated beverages is shown and described in U.S. Pat. No. 2,184,397. This dispenser includes a cylindrical case for receiving cans filled with beverage and gas for powering the dispensing of the beverage. The undissolved gas forms a layer over the liquid beverage contents in the can and forces the liquid out through a conduit having a piercing blade, which penetrates through the bottom of the can when loaded into the dispenser. A sufficient amount of gas must be supplied in the can with the beverage in order to completely expel the full contents of the can.

The metal cans used in the dispenser of U.S. Pat. No. 2,184,397 contain beverage and enough undissolved gas to completely expel all of the beverage from the container. In sharp contrast, today's conventional plastic and glass beverage bottles and beverage cans are stored under a significantly lower relative pressure with a small amount of undissolved gas stored over the liquid contents therein. This is a result of today's bottles either being constructed of plastic, which has a lower tensile strength than the metal used in the cans of U.S. Pat. No. 2,184,397, or thin-walled glass so that the bottles are disposable after one use. Further, today's aluminum cans having quick opening pop tops cannot withstand relatively higher pressure contents due to the top being made of aluminum and scribed to a certain depth to provide the pop top structure.

In general, these contemporary beverage containers are packaged with only a sufficient amount of carbonation for flavoring purposes, and do not have enough undissolved gas to dispense a significant amount of the contents of the beverage container, let alone the entire contents of the beverage container. Especially, today's larger containers, such as the popular two (2) liter plastic soda bottles, have a very small amount of undissolved gas relative to the liquid volume of the container. These conventional plastic containers are hereinafter referred to as low pressure beverage containers or systems. The present invention focuses on the use of these low pressure carbonated beverage containers requiring agitation of the carbonated beverage contents of the container to liberate enough dissolved gas from the contents to power the dispensing operation. This concept does not appear to be taught or suggested by the prior art.

Further, the specific structure of the dispenser of U.S. Pat. No. 2,184,397 involves the use of a perforating point or piercing blade extending up into the container a short distance with the end sharpened to a fine point, the point being adapted to engage and cut out a small triangular portion of the bottom of a carbonated beverage containing can. In addition, the entire bottom of the container is provided with a sealing gasket made preferably of sponge rubber, but which may be made of any suitable material. This piercing and sealing combination places the entire burden of providing an adequate seal on the bottom gasket, with no additional or secondary sealing means in case of leakage of the single sealing means.

Insulated beverage containers have been around for many years. For example, most people have had experience with an insulated Thermos for storing and transporting hot liquid such as coffee or hot chocolate. Today, squeeze bottles for dispensing individual quantities of beverage have recently become popular due to their widespread use in the sports industry, such as football. Further, insulated liners for a container of cold beverage such as a can of beer have also become commonplace. However, there appears to be a void with respect to dispensers that use pre-prepared beverage containers in combination with an insulated canister having a beverage container puncturing conduit connected to a flow control valve for maintaining the container at an off-ambient temperature (e.g. refrigerated prior to loading into the canister).

Furthermore, today's beverages are frequently distributed in sealed containers having a variety of shapes and sizes. Soft drinks are typically marketed in three (3) liter, two (2) liter and one (1) liter, sixteen (16) fluid ounce and twelve (12) fluid ounce plastic or glass bottles, as well as various size cans. A shortcoming of the prior art devices is that they are not designed to universally accommodate containers of different sizes and shapes. Further, the can piercing device in U.S. Pat. No. 2,184,397 would not appear suitable for piercing the tops or caps of bottle beverage containers due to the lack of a penetrating portion of the dispensing conduit to unequivocally extend up and through the top forming a tight sealing mechanical connection.

SUMMARY OF THE INVENTION

Accordingly, it is a primary object of this invention to provide a carbonated beverage dispenser, system and method in combination with or for use with low pressure beverage containers or systems such as plastic and glass bottles.

Another object of the present invention is to provide an improved carbonated beverage dispenser and system.

A further object of the present invention is to provide a carbonated beverage dispenser having a dispensing conduit with a puncturing end for piercing into and sealing about its outer perimeter with a carbonated beverage container loaded into the dispenser.

A still further object of the present invention is to provide a carbonated beverage dispenser including a canister having an insulated lining and a dispensing conduit having a puncturing end for piercing into a carbonated beverage container loaded into the canister.

Yet another object of the present invention is to provide a carbonated beverage dispenser, which can accommodate and dispense the contents from a variety of different sized and shaped carbonated beverage containers.

Another object of the present invention is to provide a system and method of dispensing carbonated beverage with a dispenser that accommodates and dispenses the contents from a carbonated beverage container.

A further object of the present invention is to provide a system and method of dispensing a carbonated beverage from a container having low pressure contents.

These and other objects of the invention are accomplished by providing a dispenser having a canister with a dispensing tube that includes a puncturing end for penetrating into a carbonated beverage container loaded into the canister. The dispensing tube forms a seal with the punctured opening in the beverage container. In addition, a sealing gasket is provided at the bottom of the canister for sealing with the beverage container around the punctured opening in the beverage container, defining a secondary seal for the punctured opening.

Further, the canister can be provided with an insulated lining for maintaining the temperature of a beverage container placed in the dispenser. In addition, a portion of the dispensing conduit can be accommodated in the insulated lining for maintaining the temperature of any remaining liquid in the dispensing conduit after use.

Further, the dispenser can be provided with an adapter or spacer for modifying the inner dimensions of the canister so that the dispenser can accommodate different sized and shaped containers.

The method according to the invention provides a way of dispensing the entire contents of a beverage container in multiple servings over a wide range of different time periods while providing an ample amount of carbonation with each serving. The method includes using a dispenser provided with a dispensing conduit having an end for penetrating into a low pressure carbonated beverage container. The carbonated beverage in the container is dispensed by agitating the carbonated beverage, such as by shaking the dispenser, to liberate a sufficient amount of dissolved gas to power the dispensing operation. The agitation can be repeated prior to each serving to provide dispensing and to liberate enough dissolved gas after multiple servings to dispense the entire contents of the beverage container.

BRIEF DESCRIPTION OF THE DRAWINGS

Referring to the drawings, wherein like reference characters refer to like parts throughout the several views, and wherein.

DETAILED DESCRIPTION OF THE PREFERRED EMBODIMENTS

Figure 1:
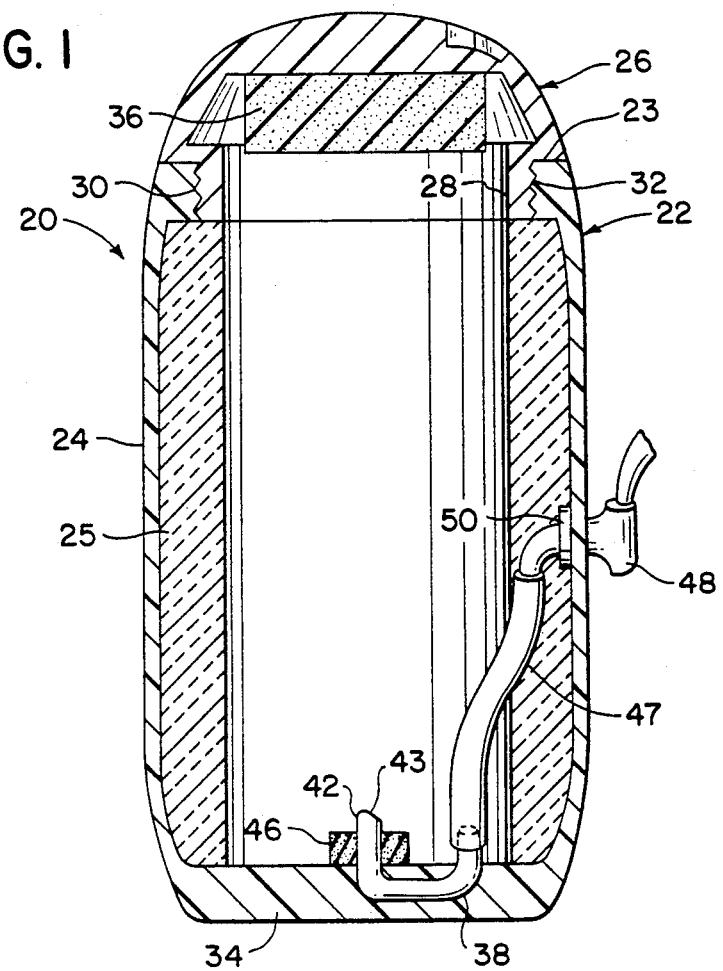
FIG. 1 is a longitudinal cross-sectional view of an embodiment of the carbonated beverage dispenser according to the present invention.

A dispenser 20 constructed according to the present invention is shown in FIG. 1.

The dispenser 20 includes a canister 22 having an open end 23 and a side wall 24. The side wall 24 is preferably lined with insulation 25. The insulation 25 can be selected from a number of different commonly know insulators such as polystyrene sold under the trademark Styrofoam or other similar materials forming a thermal barrier.

A lid 26 having a depending skirt portion 28 with external threads 30 cooperates with the open end 23 having internal threads 32 of the canister 22. Alternatively, other equivalent interlocking arrangements including arrangements that provide mechanical advantages for closing the lid during a beverage container puncturing operation can be substituted for the threaded arrangement. Further, a lower end of the canister 23 is defined by an insulated bottom wall 34.

By way of example, the outside dimensions of the canister 22 can be 7 inches (18 cm) in width and 13 ¾ inches (33 cm) in height. The inside width is approximately 5 inches (12.5 cm), and the inside height is about 12 inches (30 cm).

A compressible pressure pad 36 is installed inside the lid 26. The compressible pressure pad 36 is preferably fabricated of resilient elastic foam, or a rubber-like material or substance, and for example, the pad 36 is approximately 2 inches (5 cm) in thickness. This pad maintains a yieldable pressure on the beverage container to keep it in sealing engagement with the seal, to be described later.

The canister 22 is defined by side wall 24 and bottom wall 34, which in combination with the lid 26 form the main structure of the dispenser 20 for receiving a beverage container to be dispensed. The remaining structure to be described below involves the dispensing system.

Figure 3:
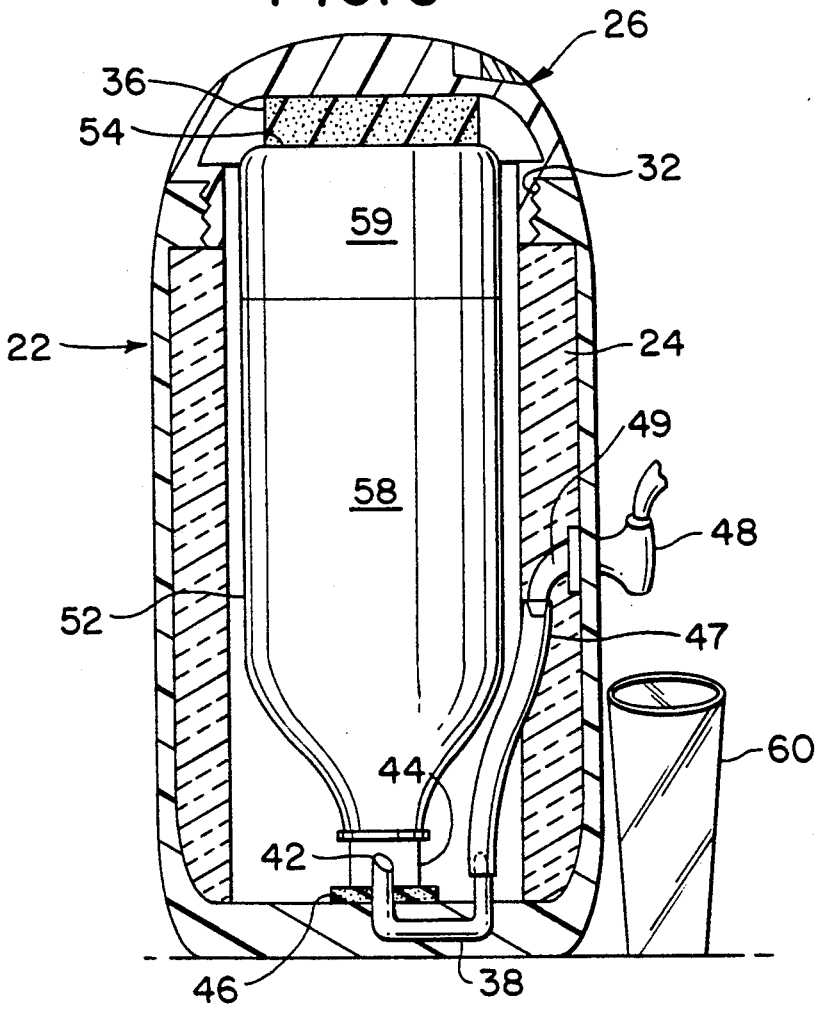
FIG. 3 is a longitudinal cross-sectional view, on a reduced scale, of the dispenser shown in FIG. 1, with a plastic beverage container loaded therein.

The dispensing system includes a dispensing tube 38 mounted at the bottom of the canister 22. The dispensing tube 38 can be mounted so that a section of it extends upwardly at approximately the center of the canister 22, so that it properly registers with the cap of an upside down beverage bottle when loaded into the canister 22, as shown in FIG. 3. Alternatively, the dispensing tube 38 can be located at other positions at the bottom of the canister 22, for example, when the dispenser will be exclusively used with beverage cans.

The dispensing tube 38 can be mounted by various means located at the bottom of the canister 22. Preferably, the dispensing tube 38 is molded into the bottom wall 34 to adequately support the dispensing tube 38 during the puncturing operation of a beverage container being loaded into the canister 22.

Further, in the embodiment shown in FIG. 1, the dispensing tube is U-shaped to facilitate construction of the canister 22. More specifically, the canister 22 is preferably made of plastic, and during construction the U-shaped structure of the dispensing tube 38 allows the dispensing tube to be imbedded into the bottom wall 34 while both ends of the dispensing tube remain open for subsequent construction of the dispensing system to be described below.

Figure 3A:
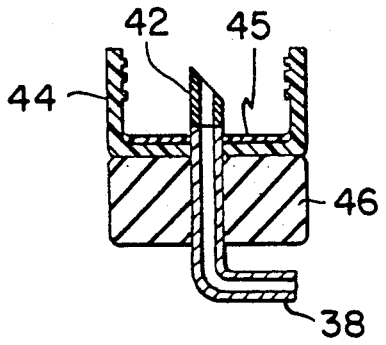
FIG. 3A is a detailed cross-sectional view of a bottle cap in sealing engagement with the dispensing tube.
Figure 3B:
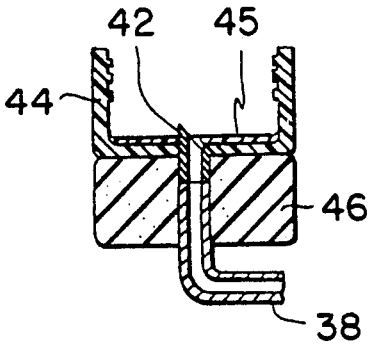
FIG. 3B is a detailed cross-section view of a bottle cap sealing with the puncturing end of the dispensing tube.

The dispensing tube 38 includes a puncturing end 42, which can be formed with a pointed angular puncturing tip 43 for penetrating through a beverage container inserted into the dispenser 20. However, the puncturing end 42 can be formed in other ways as long as it provides an adequate puncturing operation with a beverage container. Importantly, the puncturing end should penetrate the beverage container in a manner so that the opening in the beverage container, resulting from the puncturing operation, closely conforms with the perimeter of the inserted puncturing end 42 or dispensing tube 38 to form a tight seal therewith, as shown in FIGS. 3A and 3B.

Further, the puncturing end 42 may actually be the sharpened end of the dispensing tube 38 for simplicity and economy of construction purposes, without any delineation in structural components, but providing multiple functions (i.e. puncturing means of the puncturing end and fluid conduit of the dispensing tube).

The ability of the puncturing end 42 to effectively puncture and seal with the punctured opening through the beverage container closely relates to the design and construction of the puncturing end 42, and thus the puncturing end 42 should be designed for this purpose. In order to achieve this desired operation, a pointed angular cutting tip 43 can be made by grinding the puncturing end of the dispensing tube at various angles. Further, the puncturing end 42 can be made of steel (e.g. preferably stainless steel for sanitary purposes) or anodized aluminum tubing, for example, having a ¼ inch (6 mm) smooth internal surface bore. Alternatively, the puncturing end can be made of a durable material such a high carbon steel to provide years of repeated use.

The puncturing end 42 can be made as an independent replaceable unit removeably secured to the dispensing tube 38. For example, the puncturing end 42 can be provided with an internally threaded coupler to cooperate with an externally threaded end of the dispensing tube 38.

Further, the dispensing tube 38 in combination with the puncturing end 42 must have a sufficient length to puncture through and form a sealed fluid connection with the beverage container. Depending on the actual construction of the dispensing tube and the puncturing end, the puncturing end 42 may be short in length and thus require a portion of the dispensing tube 38 to enter through and seal about its outer perimeter with the punctured opening in the beverage container, as shown in FIG. 3A. Alternatively, the puncturing end 42 itself may be of sufficient length to puncture through and seal about its outer perimeter with the punctured opening of the beverage container, as shown in FIG. 3B. In either case, the puncturing end 42 is considered part of the dispensing tube 38, which must penetrate through and seal with the beverage container.

The typical plastic or glass beverage bottle is formed with either a plastic or aluminum cap 44 and a plastic sealing gasket 45. When a plastic cap is punctured by the puncturing end 42 of the dispensing tube 38, due to its elastic property, it tends to form a leakproof seal. Further, the punctured opening through the sealing gasket 45 provides a secondary seal that tends to be very leakproof due to the very elastic nature of the plastic used for this application. Even with an aluminum cap or can, the punctured opening therethrough tends to seal well due to deformational fitting by the puncturing end 42 a it penetrates through the aluminum sheet.

To provide additional sealing, the puncturing end 42 of the dispensing tube 38 passes through and is surrounded by compressible sealing gasket 46, located against the bottom wall 34. As an example, the gasket 46 is approximately ¼ to ⅜ inches in thickness, and is preferably made of a fluid impervious resilient material such as a synthetic rubber. The compressible sealing gasket 46 forms a tight seal with the beverage container, for example the cap 44 in FIGS. 3A and 3B, to provide additional sealing in the event of any leakage between the punctured opening and the dispensing tube 38 or puncturing end 42.

A length of tubing 47, for example made of plastic, connects the dispensing tube 38 to a flow control dispensing valve such as a spigot 48 to establish fluid communication therewith. A section of the tubing 47 extends through the insulated lining 24 to provide good insulation of the beverage contents therein. Alternatively, the dispensing tube 38 can extend to and be directly coupled with the spigot 48. The spigot 48 can be secured through the side wall 24 of the canister 22 by a locking nut 50. Further, the spigot 48 includes a downwardly extending elbow 49 accommodated within the insulation 25. The elbow 49 is connected to a section of the tubing 47 passing through the insulation 25. This installation provides good insulation of the beverage container.

The puncturing end 42, the dispensing tube 38, tubing 47, and spigot 48 are preferably made with smooth internal bore wall surfaces to reduce flow turbulence that would tend to liberate gas from the carbonated beverage flowing through the dispensing conduit. Further, bends in the fluid delivery system are selected to have a radius of at least ½ inch (12 mm) in order to also reduce flow turbulence. Preferably, the internal surface roughness, radius of bending, and dimensional characteristics of the entire dispensing conduit are selected to maintain a laminar flow therein.

Figure 4:
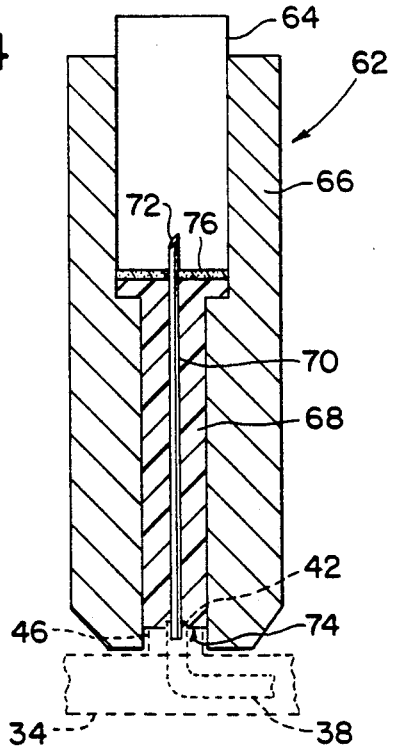
FIG. 4 is an enlarged longitudinal cross-sectional view of an adapter insert for accommodating a beverage can.

The beverage dispenser 20 according to the present invention can accommodate a variety of different sized and shaped beverage containers by the use of adapters and spacers. For example, an adapter 62 can be inserted into the canister 22 for accommodating a twelve (12) ounce aluminum soda can 64, as shown in FIG. 4. The adapter 62 includes a cylindrical support member 66 and a support core 68. An extension tube 70 is connected to the existing dispensing tube 38, and is supported by the core 68. The extension tube 70 is provided with a puncturing end 72. The bottom of the adapter 62 is provided with an annular recess 74 for accommodating the existing sealing gasket 46. Further, another sealing gasket 76 is provided for sealing against can 64.

Figure 5:
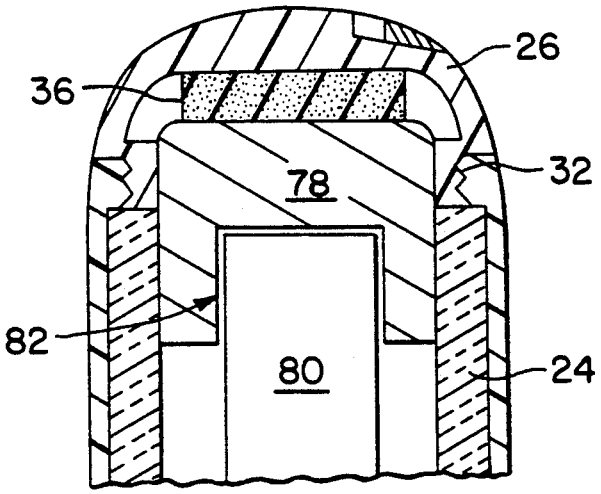
FIG. 5 is a partial longitudinal cross-sectional view of a spacer positioned inside the dispenser of the present invention for accommodating a smaller sized beverage container.

In another embodiment, a spacer 78 can be used to accommodate a smaller one (1) liter plastic beverage bottle 80 in the canister 22, as shown in FIG. 5. The spacer 78 accommodates a bottom portion 82 of the bottle 80 in the lid 26.

Figure 6B:
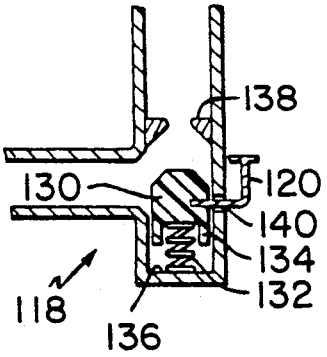
FIG. 6B is a detailed cross-sectional view of the dispensing valve structure in the alternate embodiment of the dispenser.
Figure 6A:
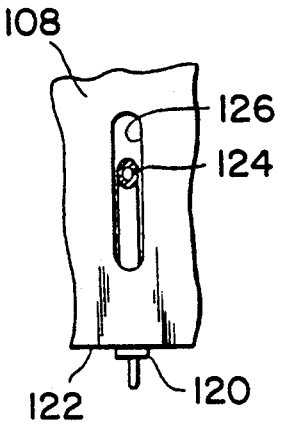
FIG. 6A is a break away view of a portion of the inner wall of the lid provided with a slot for accommodating a length of dispensing tubing, and shows the relationship between the inner wall and the spring biased dispensing actuator.
Figure 6:
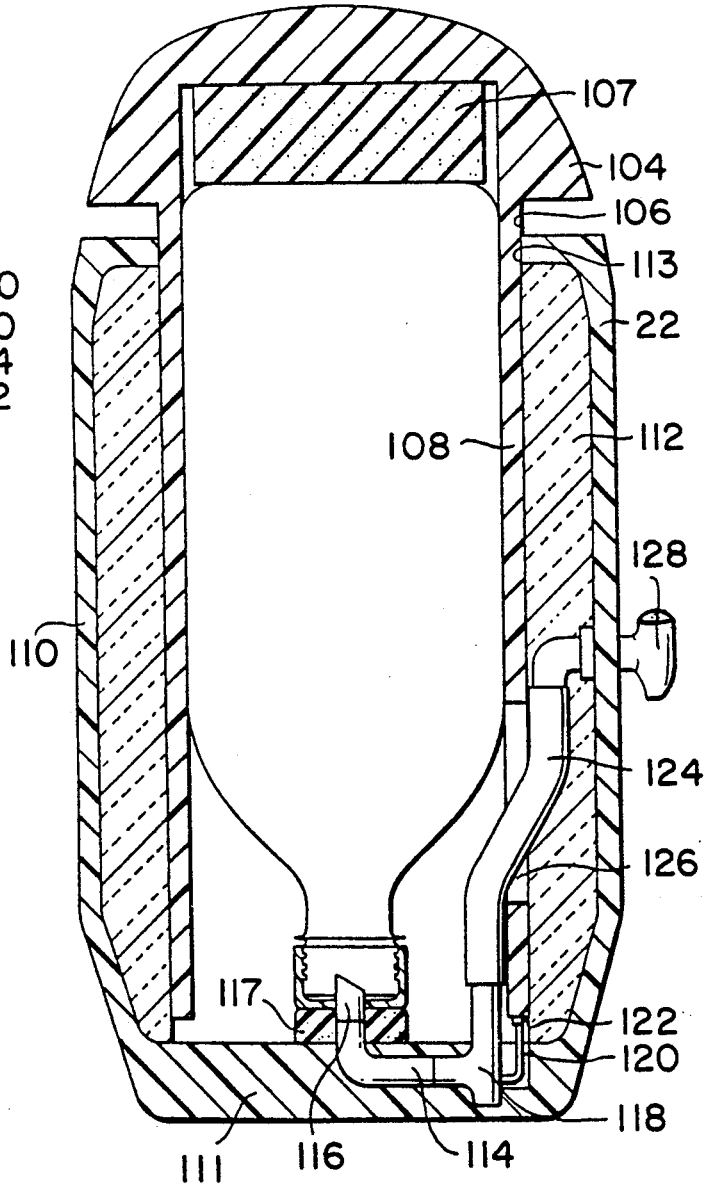
FIG. 6 is a longitudinal cross-sectional view of another embodiment of the beverage dispenser according to the present invention.

Another embodiment according to the present invention is shown in FIG. 6. In this embodiment, the beverage dispenser 100 includes a canister 102 and a lid 104. The lid 104 includes a depending skirt 106 having an inner wall 108 and a compressible pressure pad 107. The canister is defined by a side wall 110 and bottom wall 111. Further, a lining of insulation 112 is provided within the canister 102. The depending skirt 106 of the lid 104 is inserted through an opening 113 in the canister 102 so that inner wall 108 slides along the surface of the opening 113 and the surface of the lining of insulation 112 in the canister 102.

A dispensing tube 114 is embedded into the bottom wall 111 and is provided with a puncturing end 116. A compressible sealing gasket 117 is provided at the bottom of the canister 102 and surrounds the dispensing tube 116. The dispensing tube is connected to a dispensing valve 118 having a dispensing actuator 120. The bottom 122 of the inner wall 108 contacts with the actuator so the dispensing valve 118 is operated when the lid 104 is pressed downwardly by a user.

The dispensing valve 118 is connected to a length of tubing 114 that passes through a slot 126 in the inner wall 108, as shown in FIG. 6A. The opposite end of the tubing 114 is connected to spout 128.

The detailed structure of the dispensing valve 118 is shown in FIG. 6B. The dispensing valve 118 includes a plunger 130 cooperates with a seat 138 for sealing and contained between a skirt 134 of the plunger 130 and a plugged end 136 of the dispensing valve 118. The plunger 130 cooperates With a seat 138 for sealing and opening the dispensing valve 118. The dispensing actuator 120 is substantially rigidly connected to the plunger 130 and extends through a slot 140 in a wall of the dispensing valve 118.

The lid 104 is biased upwardly by the spring 132 in the dispensing valve 118 by the actuator 120 operating on the bottom 122 of the inner wall 108. In addition, other springs can be provided for this purpose. For example, springs can be imbedded in the bottom wall 111 of the canister 102 so as to operate on other portions of the bottom 122 of the inner wall 108.

OPERATION

Figure 2:
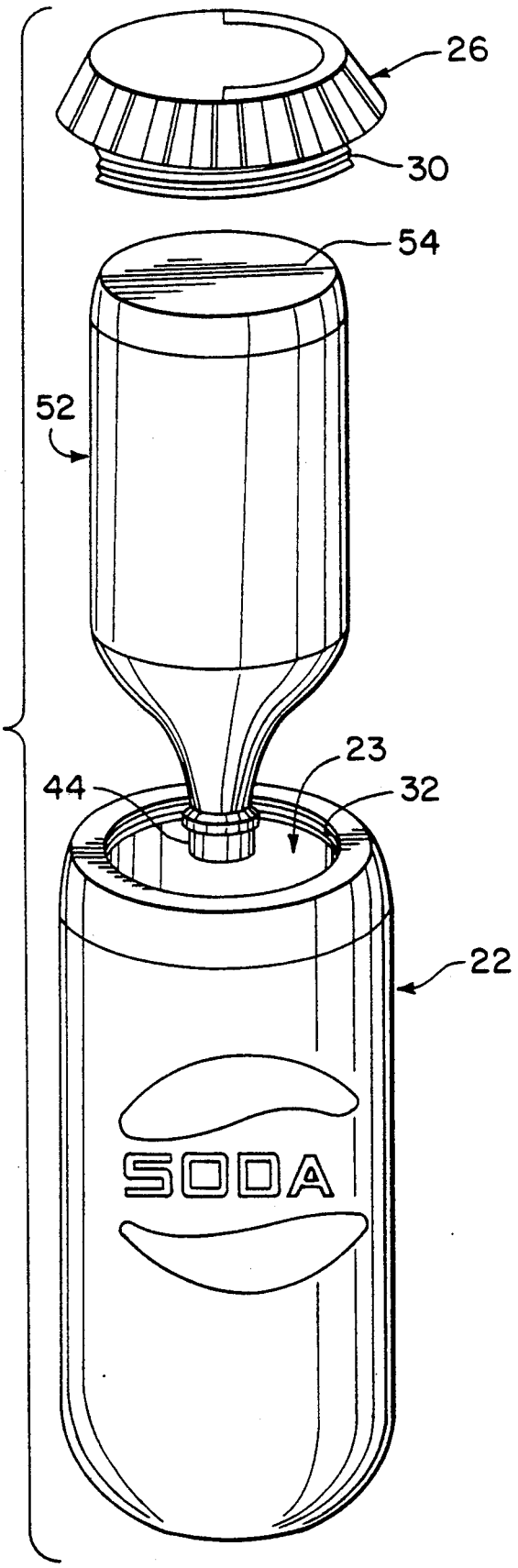
FIG. 2 is a perspective view of the carbonated beverage dispenser shown in FIG. 1, disassembled for loading a beverage container.

For the purpose of illustration; a plastic (e.g. expanded polystyrene) bottle 52 having a two (2) liter capacity, is shown in FIGS. 2 and 3. The bottle 52 is inverted prior to insertion into the canister 22 with its closure cap 44 gently resting on the puncturing end 42, and with bottom surface 54 being exposed at the open end 23 of the canister 22. With one hand holding the canister 22, the palm of the other hand is placed on the lid 26 by the user. Then, the lid 26 is swiftly pushed downwardly until the threads 30 of the lid 26 meet with the threads 32 of the canister 22. The lid 26 is then turned until fully closed, thus sealing the system from any inadvertent leaks within the dispenser 20.

The compressible pressure pad 36, which is mounted beneath the lid 26, provides a resilient biasing force against the bottom surface 54 of the bottle 52, as the lid 26 is threadably engaged with the canister 22. The biasing force urges closure cap 44 of the bottle 52 into registered engagement with the puncturing end 42 and sealing gasket 46, and maintains a continuous sealing pressure between the cap 44 and sealing gasket 46.

The canister 22 is then mechanically agitated as by shaking to release dissolved gases from the gas charged beverage 58, to form pressure pocket 59. The gas under pressure in the pressure pocket 59 forces the beverage 58 through the puncturing end 42, the dispensing tube 38 and the tubing 47 to the spigot 48. Upon opening of the spigot 48, the carbonated beverage is directed to a receptacle such as a glass 60. When the spigot 48 is closed, the dispensing system is sealed to prevent fluid or gas loss. If the flow rate decreases after the initial charging of the system by agitation, the system can be recharged by agitating or shaking the dispenser 20.

The mechanical agitation process involves the oscillation or shaking of the dispenser 20 for approximately one (1) to five (5) cycles prior to initial use. This prevents the beverage 58 from being dispensed from the dispenser 20 with a relatively high percentage of dissolved gases, which would rapidly deplete the dissolved gas available for recharging the system. Thus, a greater percentage of the undissolved gas will remain in the pressure pocket 59 to generate the necessary pressure for expelling subsequent servings of the beverage 58, and for acting as a buffer to prevent the initial serving of the dispensed beverage 58 from being overly carbonated while allowing the last available serving to contain as much dissolved gas as feasible.

The process includes similar agitation prior to each additional serving. This is repeated until the beverage 58 in the bottle 52 is used up, or until the limits of the system are reached providing a marginally carbonated beverage.

In the embodiment shown in FIG. 6, a bottle is inserted between the inner wall 108 of the lid 104, which has previously been removed from the canister 102. Then, the canister is turned upside down and the inner wall 108 is slid through the opening 113 into the canister 102 until the cap of the bottle contacts against the puncturing end 116. The dispenser as a unit is then turned right side up and placed on a supporting surface. The lid 104 is then forced downwardly causing the bottle cap to be penetrated by the puncturing tip 116.

To dispense a serving of carbonated beverage from this dispenser, the lid 104 is pressed downwardly, which forces the dispensing actuator 120 downwardly by the bottom 122 of the inner wall 108. During this operation, the plunger 130 is forced downwardly off seat 138, as shown in FIG. 6B, allowing carbonated beverage to flow through the dispensing valve 118 and flow out of the spout 128.

While the invention has been shown and described in detail, it is obvious that the invention is not to be considered as being limited to the exact form disclosed, and that changes in detail and construction may be made therein within the scope of the invention without departing from the spirit thereof.

What is claimed is:

1. A carbonated beverage dispenser, comprising:

a canister defined by a side wall and a plastic bottom wall, said canister having an open upper end for receiving a carbonated beverage container;

a lid removeably connected to the open end of said canister for closing said open end during operation;

a dispensing tube molded into the plastic bottom wall of said canister to form a durable and substantially rigid connection, said dispensing tube having a puncturing end extending inwardly of said canister from approximately the center of the bottom wall, said dispensing tube being of a sufficient length to puncture through the cap of a carbonated beverage container inserted within said canister and to form a seal with said cap around the perimeter of said dispensing tube;

a flow control valve connected to said dispensing tube for controlling the dispensing of the carbonated beverage from the dispenser; and a sealing gasket positioned on the bottom wall of said canister and forming a seal around the perimeter of said dispensing tube as well as against the cap of the beverage container.

2. A dispenser according to claim 1, wherein a thermal insulation liner is positioned within said canister.

3. A dispenser according to claim 2, wherein said bottom wall of said container is made of a material and of a sufficient thickness to provide insulating and act as a thermal barrier.

4. A dispenser according to claim 2, wherein a length of plastic tubing inside said canister connects said dispensing tube to said flow control valve.

5. A dispenser according to claim 4, wherein a section of said plastic tubing extends from said dispensing tube through an interior space within said insulating lining leading to said flow control valve.

6. A dispenser according to claim 5, wherein said flow control valve is a spigot connected through said side wall of said canister.

7. A dispenser according to claim 6, wherein said spigot includes a downwardly extending elbow disposed within said insulated lining and connected to a section of the plastic tubing passing through said insulated lining.

8. A dispenser according to claim 1, wherein said dispensing tube is U-shaped and is connected by a length of plastic tubing to said flow control valve.

9. A dispenser according to claim 8, wherein a section of said plastic tubing extends from said dispensing tube through an interior space within said insulated lining leading to said flow control valve.

10. A dispenser according to claim 9, wherein said flow control valve is a spigot connected through said side wall of said canister.

11. A dispenser according to claim 10, wherein said spigot includes a downwardly extending elbow disposed within said insulated lining and connected to a section of the plastic tubing passing through said insulated lining.

12. A dispenser according to claim 1, including means for pressing a beverage container inserted within said canister downwardly so that said puncturing end of said dispensing tube penetrates through the beverage container while the lid is being closed on said canister.

13. A dispenser according to claim 12, wherein said upper open end of said canister is internally threaded and said lid includes an externally threaded downwardly depending skirt, which together provide said means for pressing a beverage container inserted with said canister downwardly so that said puncturing end of said dispensing tube penetrates through the cap of the beverage container while the lid is being closed on said canister.

14. A dispenser according to claim 1, including a compressible pressure pad provided on the inside of said lid for maintaining pressure on a bottom portion of a beverage container inserted within said canister, for maintaining a tight seal between a cap of the beverage container and said sealing gasket.

15. A dispenser according to claim 1, including at least one adapter for accommodating various sized and shaped beverage containers within said canister, said adapter being accommodated within said canister during use.

16. A dispenser according to claim 15, wherein the adapter includes a cylindrical support member having a dispensing tube extension adapted to connect at one end with the dispensing tube provided in the bottom of the canister and to connect at its other end with a container placed in the canister, said adapter having means on one end for sealing engagement with the sealing gasket on the bottom wall of the canister, and a sealing gasket on its other end for sealing engagement with the container placed in the canister, whereby containers of substantially shorter length than those normally accommodated in the canister may be operatively placed therein.

17. A dispenser according to claim 1, wherein said puncturing end is a separate component and removeably secured to said dispensing tube.

18. A dispenser according to claim 1, wherein said lid includes a depending cylindrical inner wall which is telescopically received within said canister, and said flow control valve includes a dispensing actuator which contacts with a bottom of said inner wall during dispensing, whereby said lid can be forced downwardly to actuate said flow control valve during a dispensing operation.

19. A method of dispensing a carbonated beverage, comprising the steps of:

providing a canister having a side wall, a bottom wall and an open end with a removable lid, said lid having a compressible pressure pad provided on the inside of said lid;

loading a carbonated beverage container into the canister through the open end, said beverage container holding a quantity of beverage stored under a volume of carbon dioxide of relatively low pressure insufficient to power the discharge of the entire contents of said beverage container;

placing the lid on the canister to exert pressure from said compressible pressure pad against a bottom portion of the container and urge it against a puncturing end of a dispensing tube provided inside of said canister, to puncture said container and simultaneously seal said container punctured end relative to said canister;

shaking the canister and the beverage container positioned therein to release a quantity of dissolved carbon dioxide gas from the beverage in the container to pressurize the beverage;

controlling dispensing of carbonated beverage from said container by operating a flow control valve connected to said dispensing tube;

dispensing a quantity of beverage from said dispenser by opening said flow control valve; and repeating the step of agitating the beverage container positioned in the dispenser to release dissolved carbon dioxide and pressurize the beverage until the beverage is fully dispensed.

20. A method according to claim 19, including the step of reloading another container of beverage in the canister after consumption of the contents of the previous beverage container.

21. A carbonated beverage dispenser, comprising:

a canister defined by a side wall and bottom wall, said canister having an open upper end for receiving a carbonated beverage container and a thermal insulation liner positioned within said canister;

a lid removeably connected to the open end of said canister for closing said open end during operation;

a dispensing tube provided at the bottom wall of said canister, said dispensing tube having a puncturing end extending inwardly of said canister from approximately the center of the bottom wall, said dispensing tube being of a sufficient length to puncture through the cap of a carbonated beverage container inserted within said canister and to form a seal with said cap around the perimeter of said dispensing tube;

a flow control valve connected to said dispensing tube for controlling the dispensing of the carbonated beverage from the dispenser, wherein a length of plastic tubing extends from said dispensing tube through an interior space within said thermal insulation liner leading to said flow control valve and said flow control valve includes a downwardly extending elbow disposed within said thermal insulation liner and connected to a section of the plastic tubing passing through said thermal insulation liner; and a sealing gasket positioned on the bottom wall of said canister and forming a seal around the perimeter of said dispensing tube as well as against the cap of the beverage container.

22. A carbonated beverage dispenser, comprising:

a canister defined by a side wall and bottom wall, said canister having an open upper end for receiving a carbonated beverage container;

a lid removeably connected to the open end of said canister for closing said open end during operation;

a dispensing tube provided at the bottom wall of said canister, said dispensing tube having a puncturing end extending inwardly of said canister from approximately the center of the bottom wall, said dispensing tube being of a sufficient length to puncture through the cap of a carbonated beverage container inserted within said canister and to form a seal with said cap around the perimeter of said dispensing tube;

a flow control valve connected to said dispensing tube for controlling the dispensing of the carbonated beverage from the dispenser; and a sealing gasket positioned on the bottom wall of said canister and forming a seal around the perimeter of said dispensing tube as well as against the cap of the beverage container;

wherein said dispenser includes at least one adapted for accommodating various sized and shaped beverage containers within said canister, said adapter being accommodated within said canister during use and wherein the adapter includes a cylindrical support member having a dispensing tube extension adapted to connect at one end with the dispensing tube provided in the bottom of the canister and to connect at its other end with a container placed in the canister, said adapter having means on one end for sealing engagement with the sealing gasket on the bottom wall of the canister, and a sealing gasket on its other end for sealing engagement with the container placed in the canister, whereby containers of substantially shorter length than those normally accommodated in the canister may be operatively placed therein.

23. A carbonated beverage dispenser, comprising:

a canister defined by a side wall and bottom wall, said canister having an open upper end for receiving a carbonated beverage container;

a lid removeably connected to the open end of said canister for closing said open end during operation;

a dispensing tube provided at the bottom wall of said canister, said dispensing tube having a puncturing end extending inwardly of said canister from approximately the center of the bottom wall, said dispensing tube being of a sufficient length to puncture through the cap of a carbonated beverage container inserted within said canister and to form a seal with said cap around the perimeter of said dispensing tube;

a flow control valve connected to said dispensing tube for controlling the dispensing of the carbonated beverage from the dispenser; and a sealing gasket positioned on the bottom wall of said canister and forming a seal around the perimeter of said dispensing tube as well as against the cap of the beverage container;

wherein said lid includes a depending cylindrical inner wall which is telescopically received within said canister, and said flow control valve includes a dispenser actuator which contacts with a bottom of said inner wall during dispensing, whereby said lid can be forced downwardly to actuate said flow control valve during a dispensing operation.

* * * * *

UNITED STATES PATENT AND TRADEMARK OFFICE

CERTIFICATE OF CORRECTION

PATENT NO. : 5,118,009

DATED : June 2, 1992

INVENTOR(S) : Charles NOVITSKY

It is certified that error appears in the above-identified patent and that said Letters Patent is hereby corrected as shown below:

Col. 9, line 39, claim 3, line 39, change

"insulating" to --insulation--.

In column 12, line 13, i.e., claim 22, line 23, change

"adapted" to --adapter--;

line 55, claim 23, line 56, change

"dispenser" to --dispensing--.

Signed and Sealed this

Twenty-fourth Day of August, 1993

Bruce Lehman

*Attest:*

BRUCE LEHMAN

*Attesting Officer*

*Commissioner of Patents and Trademarks*